United States Patent [19]

Woolston et al.

[11] 4,289,052

[45] Sep. 15, 1981

[54] WEB GAP CONTROL FOR CORRUGATOR

[75] Inventors: A. Brent Woolston, Palmyra; Donald J. Evans, Cherry Hill, both of N.J.

[73] Assignee: Molins Machine Company, Inc., Cherry Hill, N.J.

[21] Appl. No.: 82,268

[22] Filed: Oct. 5, 1979

[51] Int. Cl.[3] ..... B26D 7/06; B26D 7/32; B65H 29/66

[52] U.S. Cl. ..... 83/26; 83/73; 83/79; 83/88; 83/110; 271/182; 271/183; 271/202; 271/199

[58] Field of Search ..... 271/202, 203, 182, 183, 271/258, 259, 270, 199; 198/423, 572, 577, 460, 571, 575; 83/88, 72, 73, 74, 75, 26, 79, 110

[56] References Cited

U.S. PATENT DOCUMENTS

| | | | |
|---|---|---|---|
| 3,315,956 | 4/1967 | Lyman | 271/202 X |
| 3,507,489 | 4/1970 | Wilshin et al. | 271/202 X |
| 3,542,362 | 11/1970 | Brockmuller et al. | 271/202 |
| 3,565,423 | 2/1971 | Kluth | 271/202 X |
| 3,659,839 | 5/1972 | Baucke | 271/183 |
| 3,724,840 | 4/1973 | Kuckhermann | 271/183 |
| 4,190,146 | 2/1980 | Knuchel | 198/460 |

*Primary Examiner*—Bruce H. Stoner, Jr.

*Attorney, Agent, or Firm*—Seidel, Gonda, Goldhammer & Panitch

[57] ABSTRACT

The size of the gap between the leading and trailing portions of a severed web is monitored with respect to an upper limit. The severed web is cut into box blanks which are transported on a stacker conveyor in shingled relation. The speed of the severed web through the corrugator is continuously controlled to prevent the gap from exceeding the limit when the gap reaches the stacker conveyor. Alternatively, the stacker conveyor is temporarily stopped until the size of the gap falls below the limit, and the stacker conveyor is re-started before the gap can close. In either case, the gap control prevents bumping of consecutive box blanks on the stacker conveyor following a change-over of production runs while insuring that the first blank of the new production run shingles on the last blank of the old production run with sufficient tail to insure retention of the first blank by stacker conveyor suction cups or tail grabbers.

15 Claims, 6 Drawing Figures

WEB GAP CONTROL FOR CORRUGATOR

BACKGROUND OF THE INVENTION

The invention is directed to a web gap control for a corrugator. More particularly, the invention is directed to a method of and apparatus for controlling the size of gap between the trailing and leading portions of a web of corrugated paperboard which has been severed to initiate a new production run.

Conventionally, when changing from an old production run to a new production run, the web is severed at a station between the end of a double facer machine and a slitter-scorer machine. The leading portion of the web proceeds at an accelerating speed through the slitter-scorer machine to a cut-off machine which cuts the leading portion of the web into box blanks for the old production run. These box blanks are directed onto a stacker conveyor. The trailing portion of the web follows. Box blanks of the new production run are cut from the trailing portion of the web and are added to those already on the stacker conveyor. If the gap which has formed between the leading and trailing portions of the web becomes too large, the leading edge of the first box blank of the new production run can bump the already imbricated sheets of the old production run on the stacker conveyor, generally disarranging the box blanks of the old production run.

Various techniques exist for the detection of a web gap in a sheet processing machine. For example, U.S. Pat. Nos. 3,565,423 and 3,507,489 disclose sheet delivery devices wherein a gap in a shingled production run is automatically detected and closed. In U.S. Pat. No. 3,565,423, the gap is created by the deliberate removal of a defective sheet from the run. The gap is optically detected, and a delivery conveyor is stopped momentarily to permit the gap to close.

In U.S. Pat. No. 3,507,489, the gap is also optically detected, and the conveyor is stopped momentarily to permit the gap to close.

It is also known in the paperboard industry to momentarily stop the stacker conveyor until the first sheet or blank of the new run reaches the last blank of the old run on the stacker conveyor. By this technique, the gap between the blanks is closed at the stacker conveyor before the stacker conveyor is re-started. In this case, the first blank of the new run shingles on the last blank of the old run and consecutive blanks of the new run accumulate on the first blank until the stacker conveyor is re-started. The first new run blank may not present sufficient tail to permit retention by the conveyor suction cups or tail grabbers so that the old run can be separated and cleared from the new run on the stacker conveyor.

Heretofore, the problem of preventing bumping of consecutive blanks on the stacker conveyor while insuring retention of the new run blank has not been resolved.

Accordingly, there is need for a control which limits the size of gap between the trailing edge of the last sheet or blank of an old production run and the leading edge of the first sheet or blank of a new production run so that the first sheet falls upon the sheets already shingled on the stacker conveyor at such an angle that the shingled sheets are not disturbed. There must also be provision of sufficient tail on the new sheet for the conveyor retarding means to seize the new sheet to allow the old sheets to be taken away with their arrangement intact.

BRIEF SUMMARY OF THE INVENTION

The invention disclosed herein represents an improvement over that shown and described in copending application Ser. No. 903,350 entitled "Continuous Running Corrugator" filed May 5, 1978, now U.S. Pat. No. 4,240,856, and assigned to the assignee herein. That application describes a method of creating a gap between the sheets of one production run and the sheets of a subsequent production run to prevent interference between the sheets of the two production runs. Control of the sheets on the stacker conveyor can also be obtained by partially overlaying the first sheet of the new production run on the last sheet of the old production run. When this is done, however, the first new sheet tends to strike or bump the shingled sheets on the stacker conveyor obliquely, thereby disarranging the old sheets. This bumping of the previously shingled sheets caused a jam with a resultant shutting down of the apparatus to allow attendants to clear the jam.

In the present invention, the gap between the leading and trailing severed web portions is monitored and the speed of the web is controlled so that the gap does not exceed an upper limit. Instead of closing the gap, the gap is permitted to vary over a range of values within certain preselected limits. Accordingly, when the first full size blank of a new production run shingles on the last blank of the old production run on the stacker conveyor, the first blank has sufficient tail to insure retention of the blank by the stacker conveyor suction cups or tail grabbers while the old production run blanks are cleared by the stacker conveyor.

In one embodiment of the invention, the gap between the leading and trailing severed web portions is continuously monitored and the motor drives for the slitter-scorer and cut-off machines of the corrugator are controlled to prevent the gap from exceeding an upper limit beyond which bumping would occur between consecutive blanks on the stacker conveyor. In this embodiment, the stacker conveyor is run continuously. The slitter-scorer and cut-off machines and the stacker conveyor are associated with separate dc motor drive controls.

Alternatively, web gap control can be exercised to prevent bumping between consecutive blanks by interrupting the stacker conveyor motor drive. In this embodiment, a stacker conveyor motor drive control stop signal is generated to stop the stacker conveyor when it is determined that the gap exceeds the limit. When the gap falls below the limit, the stop signal is removed and the stacker conveyor is re-started.

For practical reasons, the gap size cannot be monitored by varying the speed of the double facer machine. The double facer machine extends approximately 100 feet upstream from the shear. The board from the double facer machine is propelled by belts, and changing the speed of these belts to accommodate the small increments to suit the desired gap is not technically feasible.

An advantage of the invention is that it prevents bumping of box blanks of consecutive production runs on the stacker conveyor.

Another advantage of the invention is that it prevents bumping of the box blanks on the stacker conveyor while insuring sufficient tail on the first blank of a new run so that the blank can be retained by the stacker conveyor suction cups or tail grabbers while the old run box blanks are cleared on the stacker conveyor.

Another advantage of the invention is that it can be easily implemented in a corrugator whether the stacker conveyor is continuously or intermittently operated.

Further advantages appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
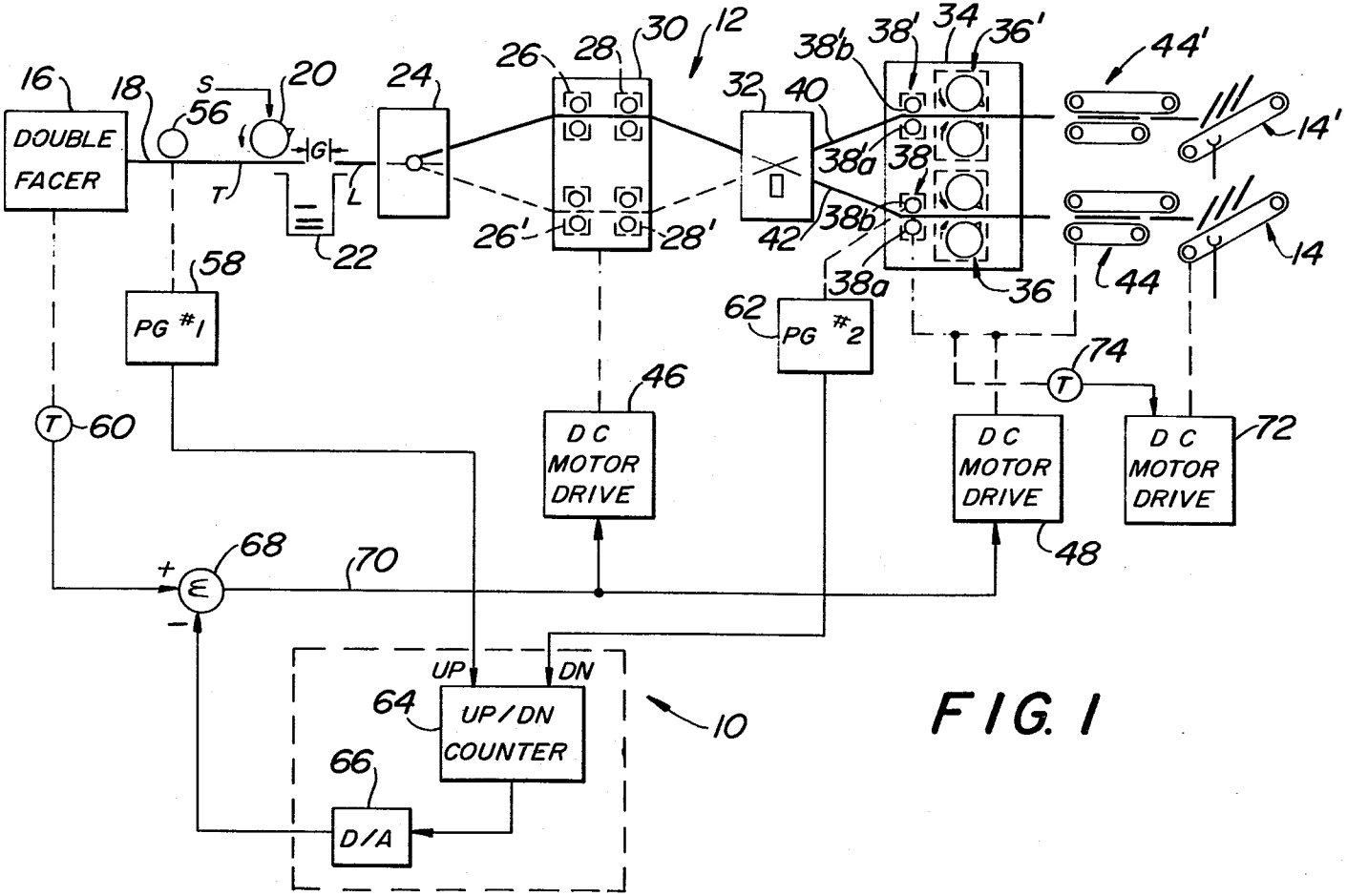
FIG. 1 is a block diagram of the web gap control of the present invention for a corrugator including a continuously running stacker conveyor.

Referring to the drawings, wherein like numerals indicate like elements, there is shown in FIG. 1 a web gap control 10 for a corrugator 12 including continuously running stacker conveyors 14, 14'.

The corrugator 12 includes a web producing machine 16, such as a double facer machine, which produces a moving web 18. The double facer produces a moving web 18 which is a continuous web of double faced corrugated paperboard. The invention herein, however, is not limited by the particular type of web produced by the web producing machine 16. The moving web 18 moves through a rotary shear 20 over a hopper 22 to a web diverter machine 24. The hopper 22 may collect scrap which is cut from web 18 by shear 20. The web diverter machine 24 diverts the moving web 18 to either the scorer heads 26 and the slitter heads 28 of a slitter-scorer machine 30 or to the scorer heads 26' and slitter heads 28' of the slitter scorer machine (as indicated by broken lines in FIG. 1). As shown in FIG. 1, the web is diverted to heads 26, 28. At the slitter-scorer machine 30, the scorer heads 26 score the web 18 and the slitter heads 28 slit or trim the web longitudinally at preselected locations to provide at least two moving webs of different widths or one web if the web is only trimmed. The scored and slit web advances to a slat table 32 which separates the web portions along the longitudinal slit into webs 40 and 42 for simultaneous processing into box blanks of preselected lengths by a cut-off machine 34.

The cut-off machine 34 includes pairs of upper and lower rotary cut-off knives 36 and 36' respectively. A pair of pull rolls 38 is associated with cut-off knives 36. A pair of pull rolls 38' is associated with cut-off knives 36'. The pull rolls pull the separated webs 40 and 42 to the respective cut-off knives 36, 36'. The cut-off knives 36 and 36' are adjusted to cut the webs 40, 42 respectively into box blanks of preselected lengths. The knives 36, 36' can be adjusted as desired to cut different or identical lengths of box blanks from the webs 40, 42.

Figure 4:
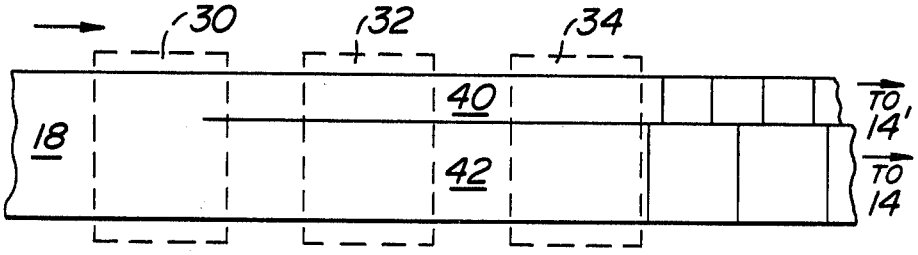
FIG. 4 is a plan view of a moving web which is slit and cut into box blanks by the corrugator.

The box blanks produced by cut-off knives 36 are transported by a cut-off conveyor 44 to the stacker conveyor 14. The box blanks produced by cut-off knives 36' are transported by cut-off conveyor 44' to stacker conveyor 14'. A plan view of the webs 18, 40 and 42 and the box blanks produced by the cut-off machine 34 is shown in FIG. 4. The box blanks are deposited on stacker conveyors 14, 14' in shingled relation owing to differences in the speeds of the cut-off conveyors 44, 44' and their associated stacker conveyors 14, 14' respectively. Thus, each stacker conveyor is run at a speed slower than its associated cut-off conveyor to obtain the desired shingling relation between the box blanks deposited on the stacker conveyor. The shingle ratio between box blanks on each stacker conveyor is determined by the ratio of the speed of the stacker conveyor to the speed of the associated cut-off conveyor.

In the corrugator 12 shown in FIG. 1, the web gap control 10 operates the dc motor drive 46 for slitter and scorer heads 28, 26 and pull rolls (not shown) of slitter-scorer machine 30 associated with the heads 26, 28; and the dc motor drive 48 drives the pull roll **38*a* of cut-off machine 34 as well as the cut-off conveyor 44. Appropriate gearing is provided at the cut-off machine 34 and the cut-off conveyor 44 so that the driven pull roll 38*a* and the cut-off conveyor 44** are driven at different speeds.

The dc motor drive 46 either drives the slitter and scorer heads 28, 26 or the heads 28', 26'. Either heads 26, 28 or heads 26', 28' are engaged via a clutch depending on which web line (40 or 42) is in use.

The dc motor drive 48 drives pull rolls **38*a*, 38*a'* and cut-off conveyors 44, 44' by way of appropriate gearing. Each of the rollers 38*b*, 38*b'* is an idler roller associated with a pulse generator. Idler rollers 38*b*, 38*b'* ride on the web. Each pulse generator measures the amount of web passing the associated idler roller. A separate control (not shown) determines which pulse generator is in use. Thus, if there is no web at knives 36, the pulse generator (not shown) associated with idler roller 38'*b* is used. If there is no web at knives 36', the pulse generator 62 associated with idler roller 38*b*** is used.

Typically, shear 20 is located approximately 40 feet from cut-off conveyor 44, and cut-off knives 36 are between 5 and 8 feet from the cut-off conveyor. During a production run, the moving web 18 is fed past the shear 20, through the web diverter machine 24, the slitter-scorer machine 30 and over the slat table 32. At the slat table 32, the production run can be separated into two webs 40, 42 for processing by the cut-off machine 34.

At the cut-off machine 34, the web 42 is pulled by pull rolls 38 through cut-off knives 36 which cut the web into box blanks of preselected lengths. The box blanks are transported by the cut-off conveyor 44 to the stacker conveyor 14 where they are transported in shingled relation.

Preferably, the slitter-scorer machine 30 is driven at approximately 2% over line speed. By line speed is meant the nominal speed at which the web 18 issues from the double facer machine. The pull roll 38 is driven at approximately 4% over line speed, and the cut-off conveyor is driven at approximately 6% over line speed. As a result, during a production run, there is slippage between the web 18 which moves at line speed and the pull rolls (not shown) of the slitter-scorer machine 30 and the pull rolls 38*a*, 38*a'* of the cut-off machine 34 which are driven faster than line speed.

When a new production run is ordered, a production run change signal S is generated either manually or automatically. The run change signal S causes the shear 20 to sever the web 18 into a leading portion L and a trailing portion T. Box blanks of the old production run are cut from the leading portion L of the severed web. Box blanks of the new production run are cut from the trailing portion T of the severed web. Owing to the overspeed of the pull roll of the slitter-scorer machine 30 and the pull roll 38*a*, leading portion L of the severed web is accelerated towards the cut-off conveyor 44 while the trailing portion T of the severed web continues to move at nominal line speed. Accordingly, a separation or gap G is naturally created between the leading portion L and the trailing portion T of the severed web. The gap increases in size as it moves through the corrugator 12.

Figure 5:
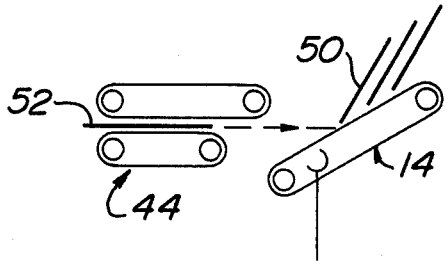
FIG. 5 is a diagram showing bumping of consecutive box blanks on the stacker conveyor after a change-over in production runs.
Figure 6:
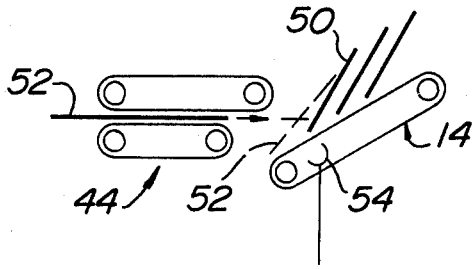
FIG. 6 is a diagram showing shingling of consecutive box blanks on the stacker conveyor after a change-over in production runs.

If the size of gap G exceeds an upper limit, say 15 inches or more for the distances and speeds given above, the first blank cut from the trailing portion T of the severed web will strike the stacker conveyor and butt or bump up against the last blank cut from the leading portion L of the severed web. This relationship is shown in FIG. 5 wherein the last blank cut from web L is designated 50 and the first blank cut from web T is designated 52. The blank 52 will displace blank 50 on stacker conveyor 14 and will not shingle on blank 50. To avoid bumping of blanks 52 and 50, the gap G must be controlled so that it does not exceed the upper limit. By controlling the size of the gap G in this manner, the blank 52 will strike an intermediate region of blank 50 on stacker conveyor 14, and the blank 52 will slide up and shingle on blank 50 as shown in FIG. 6.

Additionally, by permitting the gap G to exist so long as the gap does not exceed the upper limit, the blank 52 will shingle on blank 50 on the stacker conveyor 14 while providing sufficient tail for the suction cups 54 or tail grabbers of the stacker conveyor. The suction cups 54 can then be operated to grab the tail of blank 52 while the old production run, terminating with blank 50, is cleared by the stacker conveyor. If the gap G were closed by the control 10, blank 52 would shingle on blank 50 on stacker conveyor 14, but the tail of blank 52 might not be sufficiently large to permit retention by the suction cups 54.

CONTINUOUSLY RUNNING STACKER CONVEYOR

In operation, before the web 18 is severed by shear 20, a measuring roll or encoder 56 and pulse generator 58 provide a speed signal representative of the speed of the web 18 issuing from the double facer machine 16. See FIG. 1. The signal produced by pulse generator 58 is a stream of pulses whose frequency varies with the speed of the web 18. Nominally, the web 18 moves at line speed. A speed signal is also generated by a tachometer 60 which senses the speed of the drive shaft (not shown) of the double facer 16. The output of the tachometer 60 is an analog signal which varies with the speed of the drive shaft of the double facer machine 16. The speed of the web 18 at the cut-off machine 34 is sensed by a pulse generator 62 coupled mechanically to idler pull roll 38*b*. The output of the pulse generator 62 is a stream of pulses whose frequency varies with the speed of the web 18 as it moves through the cut-off machine 34. Nominally, before web 18 is severed by shear 20, the speed of the web 18 through the cut-off machine 34 is also line speed.

An up/down counter 64 counts up the pulses generated by pulse generator 58 and counts down the pulses generated by pulse generator 62. The net count in counter 64 is transmitted to a digital-to-analog converter 66. The output of the digital-to-analog converter 66 is proportional to the difference in speed of the web 18 at the measuring roll 56 and the idler roll 38*b*. Prior to operation of the shear 20, this difference in speed is nominally zero.

The output of the digital-to-analog converter 66 is subtracted from the output of the tachometer 60 by a summer circuit 68. The output 70 of summer circuit 68 is a motor drive control signal which controls the dc motor drives 46 and 48. Assuming no difference in speed of the web 18 at rolls 56 and 38*b*, the dc motor drives 46, 48 are controlled by the speed output signal generated by tachometer 60. The motor drive circuits 46, 48 vary the speeds of the slitter-scorer machine 30 and cut-off machine 34, respectively, in proportion to variations of the speed of the drive shaft of the double facer machine 16. In addition, the motor drive 48 varies the speed of cut-off conveyor 44 in proportion to fluctuations in the speed of operation of the double facer machine 16. The speed of the stacker conveyor 14 is varied by a dc motor drive 72 in response to speed variations of the driven roll 38*a* of the cut-off machine 34 which are sensed by tachometer 74.

During a production run, therefore, box blanks are produced by the cut-off machine 34 and transported by cut-off conveyor 44 to the stacker conveyor 14 where the blanks are shingled. The separation between box blanks between the cut-off machine 34 and stacker conveyor 14 is usually small enough to present no problem of bumping between consecutive box blanks on the stacker conveyor. Normally, the stacker conveyor 14 is inclined at a preseleted angle to avoid bumping. The larger the separation between box blanks, the larger will be the angle of inclination of the conveyor.

In changing from one production run to another, the shear 20 severs the web 18 into the leading portion L and the trailing portion T in response to the production run change signal S. As the leading portion L is accelerated towards the stacker conveyor 14, the frequency of the pulses generated by pulse generator 62 increases proportionately. The difference in speed signals generated by pulse generators 58 and 62 is accumulated by up/down counter 64. The contents of the counter are fed to the summer circuit 68 via the digital-to-analog converter 66 as previously described. The motor drive control signal generated by summer circuit 68 on line 70 is reduced proportionately. Accordingly, the dc motor drives 46 and 48 reduce the speed at which the leading portion of the severed web moves through the slitter-scorer machine 30 and cut-off machine 34, respectively. Since the trailing portion T of the severed web continues to travel at nominal line speed, the separation or gap G between the leading and trailing portions L and T of the severed web decreases in size.

Preferably, the corrective action of the summer circuit 68 is not initiated until the gap G reaches an upper limit beyond which bumping will occur at the stacker conveyor 14. In other words, a "dead band" is built into the control 10 to allow a finite gap between the leading and trailing portions L and T of the severed web as long as the upper limit is not exceeded. This is accomplished, for example, by presetting the up/down counter to a value corresponding to the upper limit for the gap G. The value of the upper limit is determined by the physical configuration of the machine, e.g., the distance Y between the cut-off conveyor and the point Z (see FIG. 5) at which a box blank would strike the stacker conveyor divided by the ratio of speed of the cut-off conveyor to speed of the stacker conveyor.

The up/down counter 64 includes appropriate conventional logic circuitry for transmitting a zero level digital signal to the digital-to-analog converter 66 until the net count of pulses generated by pulse generators 58 and 62 offsets the preset (upper limit) count of the counter. Thereafter, the net count of counter 64 is transmitted to the summer circuit 68 by the digital-to-analog converter output. The summer circuit 68 subtracts the digital-to-analog converter output from the output of tachometer 60, and the dc motor drives 46 and 48 slow the web as it passes through the slitter-scorer machine 30 and cutoff machine 34 to restore the gap G to a size less than the upper limit without closing the gap. As a result, box blanks cut by cutoff knives 36 are transported by cut-off conveyor 44 to stacker conveyor 14 without bumping on the stacker conveyor, and the blank 52 shingles on blank 50 with sufficient tail to enable the suction cups 54 to retain blank 52 while the old production run blanks are cleared on the stacker conveyor. See FIG. 6.

INTERMITTENTLY DRIVEN STACKER CONVEYOR

Figure 2:
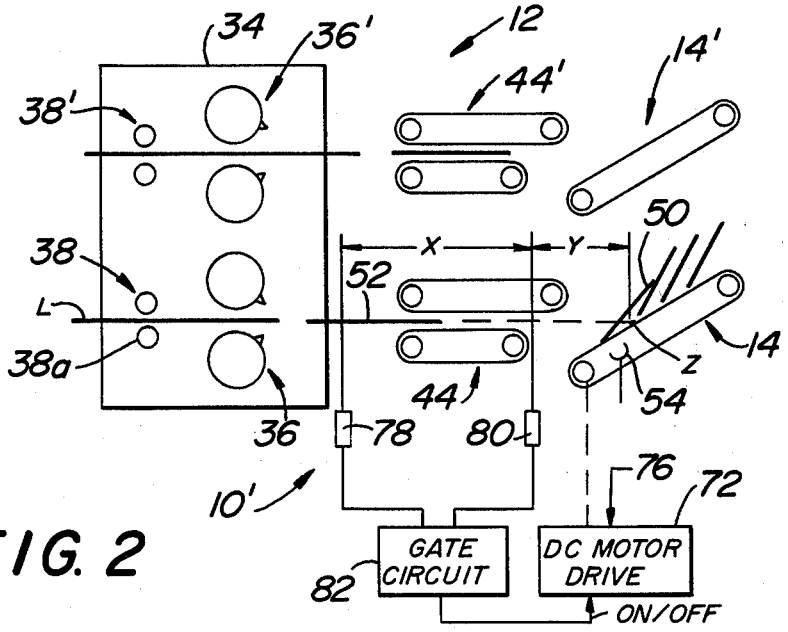
FIG. 2 is a block diagram of the invention for a corrugator including an intermittently operated stacker conveyor, using pre-positioned photodetectors.

Referring now to FIG. 2 of the drawings, there is shown a web gap control 10' for use with a corrugator 12 associated with a stacker conveyor 14 which can be intermittently driven by dc motor drive 72. The dc motor drive 72 drives the stacker conveyor 14 at a speed proportional to the double facer drive shaft speed in conventional manner in response to a speed control signal 76. For example, the speed control signal 76 may be taken off the tachometer 74 shown in FIG. 1 with the tachometer 60 directly controlling the motor drives 46 and 48, the summer circuit 68 having been eliminated.

A pair of photodetectors 78 and 80 are pre-positioned relative to the stacker conveyor 14. Photodetector 80 is preferably positioned at the exit end of the cut-off conveyor 44 a distance Y from a predetermined location Z along the stacker conveyor 14. See FIG. 2. Photodetector 78 is spaced apart from photodetector 80 by a distance X. The ratio of the distance X to the distance Y is chosen to equal the shingling ratio of the box blanks on the stacker conveyor. For example, if the shingling ratio is 2:1, the distance X is twice distance Y.

To avoid bumping, the leading edge of box blank 52 must reach the position of photodetector 80 before the trailing edge of blank 50 reaches the predetermined location Z on the stacker conveyor 14. Owing to the relation between the speeds of the cut-off conveyor and the stacker conveyor, this condition will be met when the leading edge of blank 52, traveling at the speed of pull roll 38*a*, reaches photodetector 78 before the trailing edge of blank 50, traveling at the speed of the cut-off conveyor 44, clears detector 80. When the blank 52 reaches the cut-off conveyor 44, it is accelerated to cut-off conveyor speed towards the stacker conveyor 14. During this time, the blank 50 reaches the stacker conveyor 14 and travels along the stacker conveyor at a speed less than the cut-off conveyor speed. The trailing edge of blank 50 reaches the predetermined location Z along the stacker conveyor after the leading edge of blank 52 strikes the blank 50 on the stacker conveyor and shingles on blank 50.

To prevent bumping when the gap between the leading edge of blank 52 and the trailing edge of blank 50 exceeds the distance X (with the trailing edge of blank 50 at photodetector 80), a gate circuit 82 generates a stop signal at the on/off input to the dc motor drive 72 to cause the motor drive to stop stacker conveyor 14 until the leading edge of blank 52 traverses the photodetector 78, thereby reducing the gap size. Thus, if the trailing edge of the box blank 50 has cleared photodetector 80 but the box blank 52 has not yet reached photodetector 78, the gate circuit 82 generates the stop signal.

If, however, the leading edge of box blank 52 reaches photodetector 78 before the trailing edge of box blank 50 clears photodetector 80, the gate circuit 82 does not generate the stop signal. Accordingly, the dc motor drive 72 continues to drive the stacker conveyor 14 in response to the speed control signal on line 76 as no bumping will occur for this condition.

If the stacker conveyor 14 has been stopped in response to the stop signal generated by gate circuit 82, the stacker conveyor will not be re-started until the gate circuit 82 removes the stop signal from motor drive 72. This will occur when the leading edge of box blank 52 reaches photodetector 78 with blank 50 being maintained in position on the stopped stacker conveyor. As soon as the leading edge of box blank 52 reaches photodetector 78, the gate circuit 82 removes the stop signal from the on/off input to the dc motor drive 72, box blank 52 is transported by cut-off conveyor 44 to the stacker conveyor, and box blank 52 shingles on blank 50 without bumping.

It should be appreciated that, although web gap control 10' enables the gap between blanks 50 and 52 to be reduced to a size below an upper limit beyond which bumping occurs, the gap is never closed completely while the stacker conveyor is stopped. Accordingly, when blank 52 shingles on blank 50 on stacker conveyor 14, the stacker conveyor has been re-started and blank 52 will provide sufficient tail for the suction cups 54 or tail grabbers to retain the blank in position as the old production run is cleared from the stacker conveyor.

Figure 3:
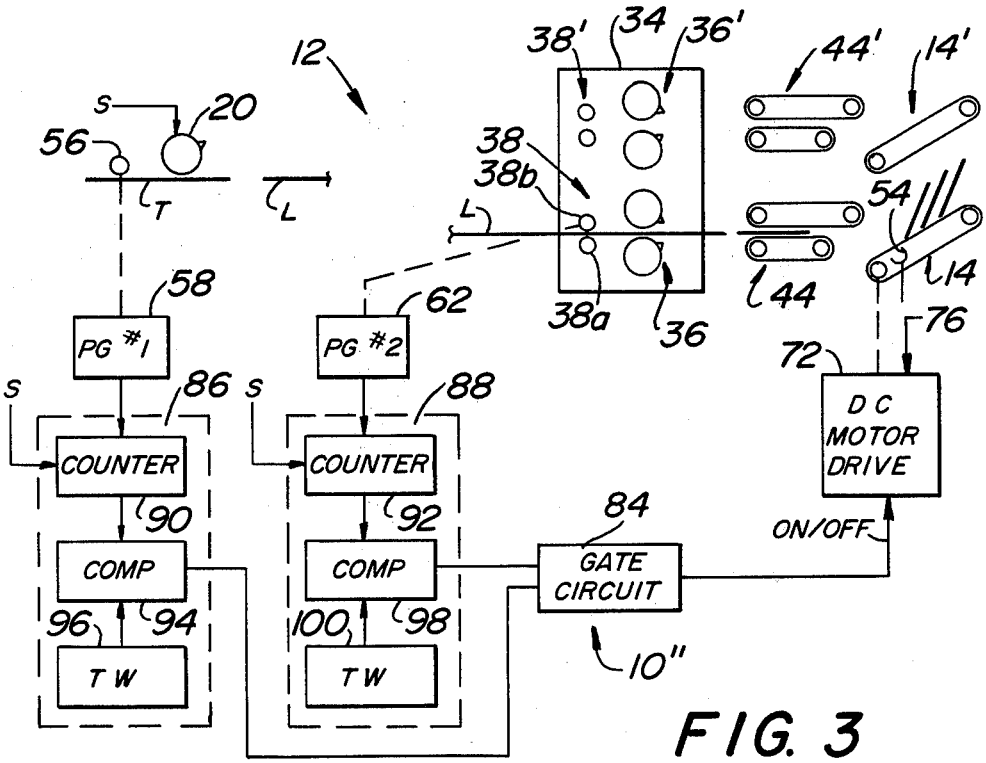
FIG. 3 is a block diagram of the invention for a corrugator including an intermittently driven stacker conveyor wherein the trailing and leading edges of the severed portions of the moving web are tracked.

Referring to FIG. 3, there is shown a web gap control 10'' for preventing bumping of consecutive box blanks on the stacker conveyor 14 by intermittent operation of the stacker conveyor. In this embodiment, the stacker conveyor is driven in conventional manner in response to the speed control signal 76 until a stop signal is generated at the on/off input to the dc motor drive 72. The stop signal is generated by a logic gate circuit 84 in response to the outputs of web travel detection circuits designated 86 and 88.

The web travel detection circuit 86 is enabled by the run change signal S which activates the shear 20 to sever the moving web into the leading and trailing portions L and T respectively. A counter 90 counts the pulses generated by pulse generator 58. The contents of counter 90, therefore, indicate the distance traveled by the leading edge of the trailing portion T of the severed web after operation of the shear 20. Similarly, web travel detection circuit 88 includes a counter 92 which counts the pulses generated by pulse generator 62. The contents of counter 92, therefore, indicate the distance traveled by the trailing edge of the leading portion L of the severed web after operation of the shear 20.

The contents of counter 90 are compared by a comparator 94 to the setting of thumb wheel switches 96. The thumb wheel switches 96 are set to the distance that the trailing portion of the severed web must travel between shear 20 and idler roll **38*b* in cut-off machine 34 less the maximum permissible separation between the leading and trailing portions L and T of the severed web beyond which bumping occurs on stacker conveyor 14. Similarly, the contents of counter 92 are compared by comparator 98 to the setting of thumb wheel switches 100. Thumb wheel switches 100 are set to the distance that the leading portion of the severed web must travel from the shear 20 to the idler roll 38*b* in the cut-off machine 34**.

If the contents of counter 92 match the setting of thumb wheel switches 100, this indicates that the trailing edge of the leading portion L of the severed web has traversed the web distance from shear 20 to idler roll **38*b* in the cut-off machine. Accordingly, comparator 98 enables gate circuit 84. If, at this time, the leading edge of the trailing portion T of the severed web is more than the maximum permissible distance from the trailing edge of the leading portion L of the web, the contents of counter 90 will be less than the setting of thumb wheel switches 96 and the output of the comparator 94 will cause logic gate circuit 84 to generate a stop signal at the on/off input to the dc motor drive 72. The dc motor drive 72 stops the stacker conveyor 14 to enable the gap between the leading and trailing web portions L and T to fall below the maximum permissible separation beyond which bumping occurs at the stacking conveyor. When the gap falls below the maximum permissible separation, the contents of counter 90 will match the setting of the thumb wheel switches 96 and the comparator 94 will disable gate circuit 84. The stop signal is thereby removed from the on/off input to the dc motor drive 72, and the stacker conveyor 14** is re-started.

Although the invention has been described in terms of specific hardware components, it should be obvious that alternative equivalent hardware and/or programmed microcomputer controls can be used within the spirit and scope of the invention.

The present invention may be embodied in other specific forms without departing from the spirit or essential attributes thereof and, accordingly, reference should be made to the appended claims, rather than to the foregoing specification, as indicating the scope of the invention.

I claim:

1. A method of imbricating box blanks delivered successively onto a stacker conveyor in a corrugator, wherein a moving web is severed into leading and trailing portions and the box blanks are cut from the leading and trailing web portions, so that the box blanks cut from the trailing portion of the severed web do not disturb those cut from the leading portion of the severed web on the stacker conveyor, comprising:

driving the stacker conveyor continuously, monitoring the size of the gap between the leading and trailing severed web portions as the portions move through the corrugator, and controlling the speed of the leading portion of the severed web to prevent the gap from exceeding an upper limit beyond which the first blank cut from the trailing portion of the severed web disturbs the last blank cut from the leading portion of the severed web on the stacker conveyor.

2. A web gap control for a corrugator which processes a moving web into box blanks including a shear for severing the moving web into leading and trailing portions, a cut-off for cutting the web portions into box blanks, and a stacker conveyor for receiving the box blanks in shingled relation, comprising:

means for continuously driving the stacker conveyor, means for monitoring the size of the gap between the leading and trailing severed web portions as the portions move through the corrugator, and means for controlling the speed of the leading portion of the severed web to prevent the gap from exceeding an upper limit beyond which the first blank cut from the trailing portion of the severed web disturbs the last blank cut from the leading portion of the severed web on the stacker conveyor.

3. A web gap control for a corrugator which processes a moving web into box blanks including a shear for severing the moving web into leading and trailing portions and a cut-off machine for cutting the web into box blanks, comprising:

means for generating a first speed signal representative of the speed of the leading portion of the severed web, means for generating a second speed signal representative of the speed of the trailing portion of the severed web, means for generating a gap signal representative of the size of the gap between said leading and trailing portions of said severed web based on the difference between said first and second speed signals, and means for varying the speed of the leading portion of said severed web in response to said gap signal so that the gap between said leading and trailing portions of said severed web is maintained below an upper limit beyond which bumping occurs at the stacker conveyor.

4. The web gap control according to claim 3 wherein said means for generating said gap signal includes a reversible counter which counts said first speed signal in one direction and counts said second speed signal in an opposite direction.

5. The web gap control according to claim 4 wherein said means for generating said first speed signal includes a first pulse generator and wherein said means for generating said second speed signal includes a second pulse generator, said reversible counter counting the outputs of said first and second pulse generators in opposite directions.

6. A method of imbricating box blanks delivered successively onto a stacker conveyor, wherein a moving web is severed into leading and trailing portions and the box blanks are cut from the leading and trailing web portions, so that the box blanks cut from the trailing portion of the severed web do not disturb those cut from the leading portion of the severed web on the stacker conveyor, comprising:

detecting the trailing edge of a first box blank at a first position relative to the stacker conveyor, detecting the leading edge of a second box blank at a second position relative to the stacker conveyor, said first and second positions being spaced apart by a preselected distance based on the desired shingle ratio for box blanks on said stacker conveyor, stopping the stacker conveyor when the trailing edge of said first box blank has been detected at said first position but the leading edge of said second box blank has not been detected at said second position, and re-starting the stacker conveyor when the leading edge of said second box blank is detected at said second position.

7. A method of imbricating box blanks delivered successively onto a stacker conveyor in a corrugator, wherein a moving web is severed into leading and trailing portions and the box blanks are cut from the leading and trailing web portions, so that the box blanks cut from the trailing portion of the severed web do not disturb those cut from the leading portion of the severed web on the stacker conveyor, comprising:

automatically monitoring the size of the gap between the leading and trailing severed web portions as the portions move through the corrugator, stopping the stacker conveyor when said gap reaches an upper limit beyond which a first blank cut from the trailing web portion disturbs a second blank cut from the leading web portion at the stacker conveyor, and re-starting the stacker conveyor when the gap size falls below said upper limit without closing said gap.

8. The method according to claim 7 wherein said step of monitoring said gap size includes determining whether the amount of travel of said trailing edge of said leading portion of said severed web reaches a first predetermined distance, and determining whether the amount of travel of said leading edge of said trailing portion of said severed web reaches a second predetermined distance equal to said first predetermined distance less said gap size upper limit.

9. The method according to claim 8 wherein said step of stopping said stacker conveyor includes stopping said stacker conveyor when the amount of travel of said trailing edge of said leading portion of said severed web reaches said first predetermined distance but the amount of travel of said leading edge of said trailing portion of said severed web has not reached said second predetermined distance.

10. A web gap control for a corrugator which processes moving web into box blanks including a shear for severing the moving web into leading and trailing portions, a cut-off for cutting the leading and trailing web portions into box blanks, and a stacker conveyor for transporting the box blanks in shingled relation, comprising:

means for generating a first web travel signal representative of the distance traveled by the trailing edge of said leading portion of said severed web, means for generating a second web travel signal representative of the distance traveled by the leading edge of said trailing portion of said severed web, means for causing said stacker conveyor to stop when the difference between said first and second web travel signals exceeds an upper limit beyond which a first box blank cut from the trailing web portion disturbs a second box blank cut from the leading web portion at the stacker conveyor, and means for re-starting said stacker conveyor when said difference between said first and second web travel signals falls below said upper limit.

11. The web gap control according to claim 10 wherein said means for generating said first web travel signal includes a pulse generator and a first counter and wherein said means for generating said second web travel signal includes a second pulse generator and a second counter, and said means for stopping said stacker conveyor includes a first comparator associated with said first counter and a second comparator associated with said second counter and logic gating for combining the outputs of said first and second comparators.

12. A web gap control for a corrugator which processes moving web into box blanks including a shear for severing the web into leading and trailing portions, a cut-off for cutting the leading and trailing web portions into box blanks, and a stacker conveyor for transporting the box blanks in shingled relation, comprising:

trailing edge detector means for detecting the trailing edge of a first box blank at a first position relative to said stacker conveyor, leading edge detector means for detecting the leading edge of a second box blank at a second position relative to said stacker conveyor, said second position being spaced apart from said first position by a preselected distance based on the shingling ratio of blanks on said stacker conveyor, means for stopping said stacker conveyor when the trailing edge of said first box blank is detected at said first position but the leading edge of said second box blank is not detected at said second position, and means for re-starting said stacker conveyor after the trailing edge of said first box blank has been detected at said first position and the leading edge of said second box blank is detected at said second position.

13. The web gap control according to claim 12 wherein said trailing edge detector means includes a first photodetector and said leading edge detector means includes a second photodetector and said means for stopping said stacker conveyor includes logic gating means for combining the outputs of said first and second photodetectors.

14. A method of controlling the gap between box blanks delivered successively onto a stacker conveyor in a corrugator wherein a moving web is severed by a shear disposed upstream of a cut-off into leading and trailing portions and the leading and trailing web portions are then cut by the cut-off into box blanks and delivered by a cut-off conveyor to the stacker conveyor, comprising:

driving the stacker conveyor continuously, monitoring the size of the gap between the leading and trailing severed web portions as the portions move between the shear and the cut-off, and controlling the speed of the leading portion of the severed web to prevent the gap from exceeding an upper limit beyond which a first blank cut from the trailing portion of the severed web disturbs the last blank cut from the leading portion of the severed web on the stacker conveyor.

15. A method of imbricating box blanks delivered successively onto a stacker conveyor in a corrugator wherein a moving web is severed by a shear disposed upstream of a cut-off into leading and trailing portions and the leading and trailing portions are then cut by the cut-off into box blanks and delivered by the cut-off conveyor to the stacker conveyor so that the first box blank cut from the trailing portion of the severed web partially overlies the last box blank cut from the leading portion of the severed web on the stacker conveyor, comprising:

driving the stacker conveyor continuously, monitoring the size of the gap between the leading and trailing severed web portions as the portions move between the shear and the cut-off, and controlling the speed of the leading portion of the severed web to prevent the gap from exceeding an upper limit without closing the gap to insure that the first box blank from the trailing portion of the severed web overlies the last box blank from the leading portion of the severed web on a stacker conveyor with sufficient tail to insure retention of the first box blank by the stacker conveyor retarding means.

* * * * *